US005182901A

United States Patent [19]

Stahlecker

[11] Patent Number: 5,182,901

[45] Date of Patent: Feb. 2, 1993

[54] SPINNING OR TWISTING SPINDLE ARRANGEMENT

[75] Inventor: Fritz Stahlecker, Bad Übergkingen, Fed. Rep. of Germany

[73] Assignee: Hans Stahlecker, Fed. Rep. of Germany; a part interest

[21] Appl. No.: 537,240

[22] Filed: Jun. 13, 1990

[30] Foreign Application Priority Data

Jun. 20, 1989 [DE] Fed. Rep. of Germany ..... 3920019

[51] Int. Cl.[5] ..... D01H 7/04; D01H 7/08; F16C 17/10

[52] U.S. Cl. ..... 57/135; 57/130; 57/134; 384/235

[58] Field of Search ..... 57/130, 132-135; 384/227, 230, 231, 234, 235, 236

[56] References Cited

U.S. PATENT DOCUMENTS

| | | | |
|---|---|---|---|
| 113,575 | 4/1871 | Sawyer | 57/135 |
| 590,380 | 9/1897 | Scheid | 384/235 |
| 2,241,140 | 5/1941 | Kennedy | 57/133 |
| 2,304,370 | 12/1942 | Neal | 57/130 |
| 2,609,254 | 9/1952 | Harris | 57/135 |
| 2,668,087 | 2/1954 | Soussloff et al. | 57/130 |
| 3,485,029 | 12/1969 | Beerli | 57/134 |
| 3,508,800 | 4/1970 | Beerli | 384/235 |
| 3,640,057 | 2/1972 | Branson | 57/130 X |
| 4,067,184 | 1/1978 | Johnson, Jr. | 57/135 |
| 4,187,668 | 2/1980 | Olowinski et al. | 57/135 X |
| 4,299,085 | 11/1981 | Olowinski et al. | 57/130 |
| 4,674,272 | 6/1987 | Widmer | 57/130 X |

FOREIGN PATENT DOCUMENTS

| | | | |
|---|---|---|---|
| 2749389 | 5/1978 | Fed. Rep. of Germany . | |
| 2845933 | 4/1980 | Fed. Rep. of Germany . | |
| 3043806 | 5/1984 | Fed. Rep. of Germany . | |
| 3620497 | 11/1987 | Fed. Rep. of Germany . | |
| 816857 | 5/1937 | France | 57/135 |
| 1433607 | 2/1966 | France | 57/130 |
| 1436036 | 3/1966 | France | 57/130 |

*Primary Examiner*—Daniel P. Stodola
*Assistant Examiner*—Michael R. Mansen
*Attorney, Agent, or Firm*—Evenson, Wands, Edwards, Lenahan & McKeown

[57] ABSTRACT

In the case of a spinning or twisting spindle, it is provided that the spindle shaft is radially fixedly disposed in the spindle bearing housing, and that centering devices and vibration damping devices are integrated into a holding arrangement for the spindle bearing housing.

15 Claims, 10 Drawing Sheets

SPINNING OR TWISTING SPINDLE ARRANGEMENT

BACKGROUND AND SUMMARY OF THE INVENTION

The invention relates to a spinning or twisting spindle having a spindle shaft, a spindle bearing housing comprising a bearing for the spindle shaft, a holding arrangement which comprises rubber-elastic elements for mounting the spindle bearing housing at a spindle rail, and centering devices and vibration damping devices.

Modern spinning and twisting spindle must essentially meet three requirements, namely (i) an alignment with respect to the center of the spinning ring, (ii) a damping of spindle vibrations in connection with an energy-saving bearing, and (iii) a reduction of noise as a result of which the noise level does not exceed 85 dBA even at spindle rotational speed of 25,000 $min^{-1}$ or 30,000 $min^{-1}$.

The spindle bearing housing is normally made of steel and comprises devices which dampen the spindle vibrations. In particular, oil spools are used, as known, for example, from the German Patent Document DE 27 49 389 A1. When spindles swing out, the oil situated in an annular gap is displaced from a narrowing point to a widened point. The resulting work leads to a damping of the vibrations of the spinning or twisting spindle.

For the purpose of reducing noise, it is known from German Patent Document DE 30 43 806 C2 and DE 28 45 933 A1 to provide rubber elastic elements in the holding arrangement for the spindle bearing housing which disconnect the spindle bearing housing from the spindle rail. As a result, vibrations originating from the spindle are not transmitted to the machine. In order to avoid in this type of a noise-reducing holding arrangement that, as a result of a contact pressure of a driving belt, the spindle escapes in the direction of the belt pressure and thus leaves its centric position, it is known from German Patent Document DE 36 20 497 A1 to arrange a compensating spring between the spindle rail and the spindle bearing housing which compensates for the contact pressure force of the driving belt.

It is an object of the invention to develop a spinning or twisting nozzle of the initially mentioned type in such a manner that, on the one hand, it meets the demands made today on spindles of this type, but, on the other hand, permits a simplification and a cost reduction with respect to manufacturing.

This object is achieved according to preferred embodiments of the invention in that the spindle shaft is radially fixedly disposed in the spindle bearing housing, and in that the centering devices and the vibration damping devices are integrated into the holding arrangement for the spindle bearing housing.

In this development, it is provided that the damping devices take over the task of damping vibrations as well as that of reducing noise. No separate components are provided for this purpose. Since the vibration damping devices and the centering devices are taken out of the spindle bearing housing, the bearing for the spindle shaft is simplified and less expensive. In addition, the spindle bearing housing is also installed into the overall vibrating system so that the vibration frequency can be reduced.

In a development of the invention, it is provided that the holding arrangement for the spindle bearing housing is divided into two structural components having an axial distance from one another which are each assigned to one of two horizontal flanges of the spindle rail. As a result, it becomes possible to better control the damping of the vibrations and the centering as well as the noise reduction since an application to the spindle bearing housing takes place at two points disposed at an axial distance. The permitted movements of the spindle bearing housing and thus of the whole spindle can therefore be controlled very well.

In a further development of the invention, it is provided that the lower structural component of the holding arrangement is equipped with devices for a radial alignment. In this case, relatively slight radial aligning motions in the area of the lower structural component of the holding arrangement suffice for achieving an alignment with respect to the center of the spinning ring in the area of the upper part of the spindle.

In a further embodiment of the invention, it is provided that preferably the lower structural component of the holding arrangement comprises elastic centering devices. The elastic centering devices provide that, independently of the vibration damping devices, during swinging-out movements, the spindle is always centered back to its center.

In this case, it is advantageous for the damping device or damping devices particularly of the lower structural component of the holding arrangement to have one or several chambers filled with a medium and deformable as a result of movements of the spindle bearing housing. The displacement of this medium which may, for example, be a viscous fluid, requires work which results in a damping.

In a further development of the invention, it is provided that the upper structural component comprises a preferably annular damping element arranged between a flange of the spindle bearing housing and the spindle rail. This upper structural component will then be used essentially for absorbing the axial loads, i.e., particularly the weight of the spinning or twisting spindle so that the lower structural component is relieved from these forces. It therefore must be designed only for applying the radial damping effects and the centering forces.

Other objects, advantages and novel features of the present invention will become apparent from the following detailed description of the invention when considered in conjunction with the accompanying drawings.

DETAILED DESCRIPTION OF THE DRAWINGS

Figure 1:
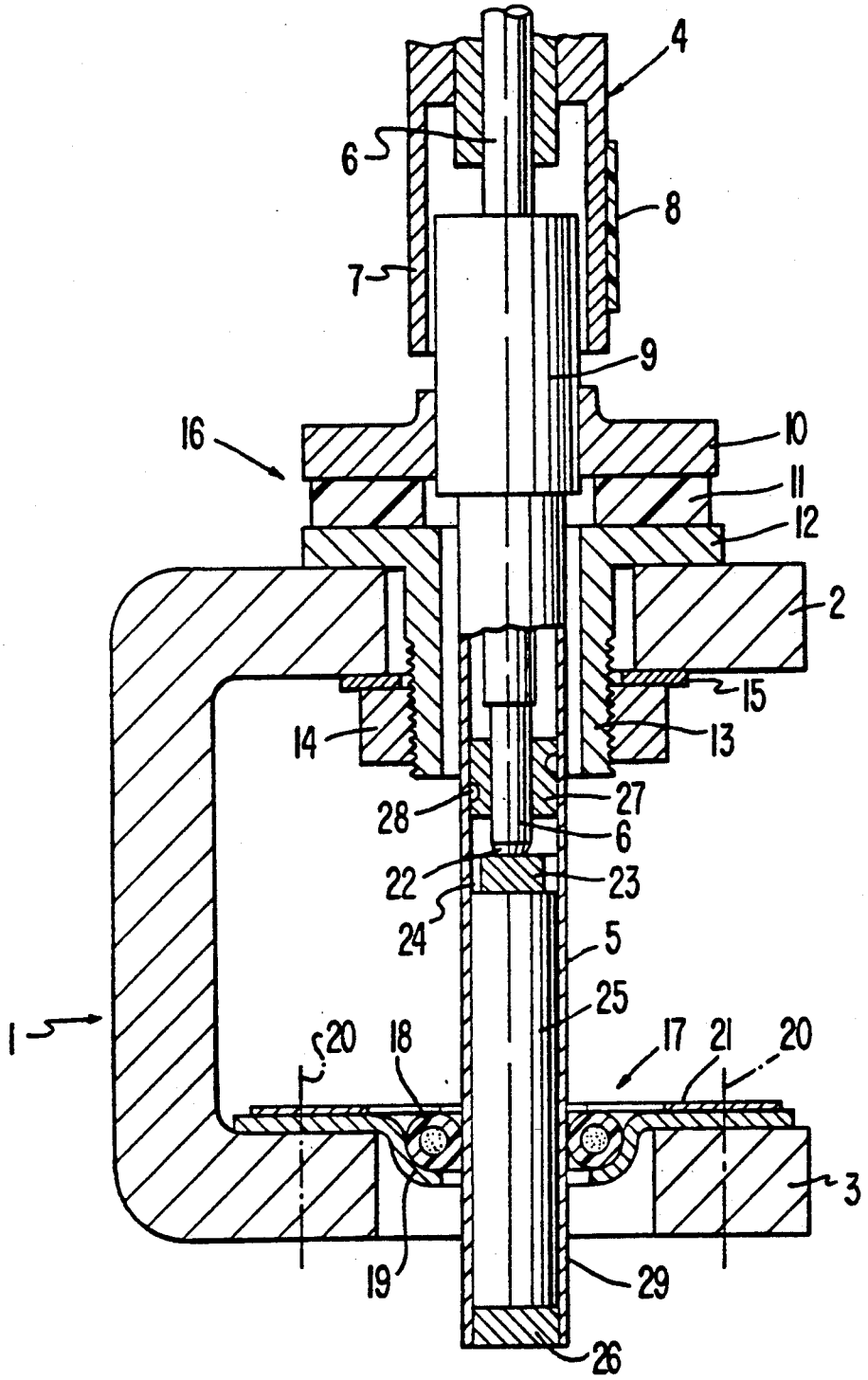
FIG. 1 is a schematic sectional view of a spinning or twisting spindle according to the invention having centering devices and vibration damping devices integrated into the holding arrangement, the holding arrangement being divided into an upper structural component and a lower structural component.

FIG. 1 shows a spindle rail 1 which has a U-shaped cross-section and two horizontally extending legs 2, 3 serving as fastening flanges for spinning or twisting spindles 4.

The spinning or twisting spindles comprise a spindle shaft 6 which is disposed in a spindle bearing housing 5. The spindle shaft 6 is disposed in the area of a widening 9 of the spindle bearing housing 5 by means of a bolster which is not shown. The spindle shaft 6 is also supported by a foot bearing 27 and a step bearing 23. The foot bearing 27 and the bolster, which is not shown, are arranged fixedly in the radial direction in the spindle bearing housing 5. The step bearing 23 comprises a plate which is pressed into the spindle bearing housing 5 and has incisions 24 in its edge area. The end 22 of the shaft 6 supports itself in the axial direction against this plate. The bolster, which is not shown in FIG. 1, is also constructed corresponding to the foot bearing 27; i.e., the spindle shaft 6 is held fixedly in the radial direction also in the area of the bolster.

The spindle bearing housing 5 is extended beyond the area of the step bearing 23 and is provided with a welded-in closing bottom 26 at its lower end 29. A supporting sleeve 25 which leaves the interior space of the spindle bearing housing 5 largely free for a lubricant reservoir, is disposed between the step bearing 23 and the welded-in closing bottom 26. The lubricant, particularly oil, can flow out by way of the recesses 24 and reach the area of the foot bearing 27 and also the area of the bolster which is not shown. For this purpose, the foot bearing 27 has a helical-line-shaped groove 28 on its outer circumference. A taking-in of lubricant takes place every time the spindle shaft 6 is pulled off and reentered. Partially, this also takes place during doffing because the spindle shaft 6 is in this case partially taken along during the lifting-off of the spool package until it strikes against a stop.

The spindle shaft 6 is non-rotatably connected with a driving wharve 7, a tangential belt 8 moving against this driving wharve 7 which is situated approximately at the level of the (not shown) bolster.

The spindle bearing housing 5 is fastened to the spindle rail 1 by means of a holding arrangement formed of an upper structural component assembly 16 and a lower structural component assembly 17. An annular flange 10 which, by means of a rubber-elastic intermediate ring 11, is connected with another annular flange 12 is fastened to the widening 9 of the spindle bearing housing 5 which has a larger wall thickness. The intermediate ring 11 is vulcanized to the annular flanges 10, 12. A threaded projection 13 connects to the annular flange 12, penetrates the upper leg 2 of the spindle rail 1, and a nut 14, with the insertion of a washer 15, being screwed onto this threaded projection 13. In this manner, the annular flange 12 is braced with respect to the leg 2. The annular flange 12 and the threaded insert 13 maintain a distance from the spindle bearing housing 5 in the radial direction so that no metallic connection exists between the spindle bearing housing 5 and the leg 2 of the spindle rail 1. The upper structural component assembly 16 of the holding arrangement absorbs all axial forces. The lower structural component assembly 17 exercises only forces in the radial direction.

The lower structural component assembly 17 has a cup 19 which is fastened by means of screws 20 to the lower leg 3 of the spindle rail 1. A damping ring 18 is disposed in the cup 19 and is held in the cup 19 by means of a disk 21 which projects into the area of the damping ring 18 by means of fingers. The screws 20, by means of which the cup 19 is fastened to the lower leg 3, are guided with a relatively large amount of play in the bores of the leg which are not shown so that the lower structural component can be adjusted and fixed in the radial direction. As a result, it becomes possible to align the spindle bearing housing 5 and therefore also the spindle shaft 6 centrically with respect to a spinning ring or the like which is not shown. As a result of the elasticity of the intermediate ring 11, this can take place without any warping of the spindle bearing housing 5. The damping ring 18, which rests against the spindle bearing housing 5 by means of its inside circumference, is a hose-type structure which is filled with a medium, particularly with a viscous fluid.

In a modification of the shown embodiment, it is provided in another embodiment that several segments are provided instead of one damping ring 18. In another embodiment, a damping device is provided which, in the manner of a mattress, is divided into several chambers which contain a gaseous or a liquid damping medium. However, in all cases, it must be observed that the damping ring 18 or the comparable damping medium are not enclosed in such a manner that it can no longer deform as a result of loads.

Figure 2:
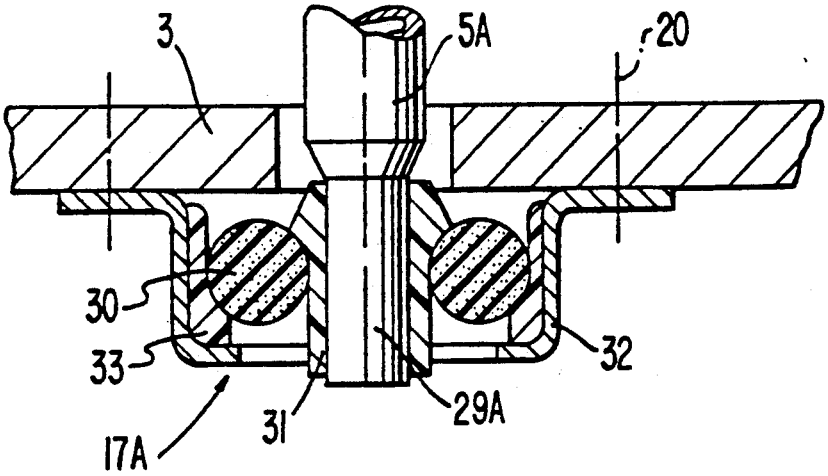
FIG. 2 is an axial sectional view of an embodiment of a lower structural component of a two-part holding arrangement.

In the embodiment according to FIG. 2, the lower structural component assembly 17A is mounted from below at the lower leg 3 of the spindle rail 1. As a damping device, it comprises a rubber elastic ring 30 with a round cross-section. A sleeve 31 consisting of plastic is fitted onto the lower end 29A of the spindle bearing housing 5A, which has a reduced cross-section, and forms a shoulder for the ring 30. The ring 30 is held in this position by means of a cup-shaped housing 32 which carries an insert 33 forming a countershoulder. Also in this embodiment, the housing 32 is fastened to the lower leg 3 by means of screws 20 in such a manner that an alignment is possible in the radial direction permitting an alignment of the spindle bearing housing 5A and thus also of the spindle shaft, which is not shown, with respect to a spinning ring or the like.

On the one hand, the ring 30 has elastic restoring characteristics and, on the other hand, it has damping characteristics. In an embodiment, it is provided that the ring 30 has a closed outer skin and, on the inside, contains a plurality of pores. It is possible, for example, to foam out a hose-type ring 30 subsequently or while it is being manufactured.

Figure 3:
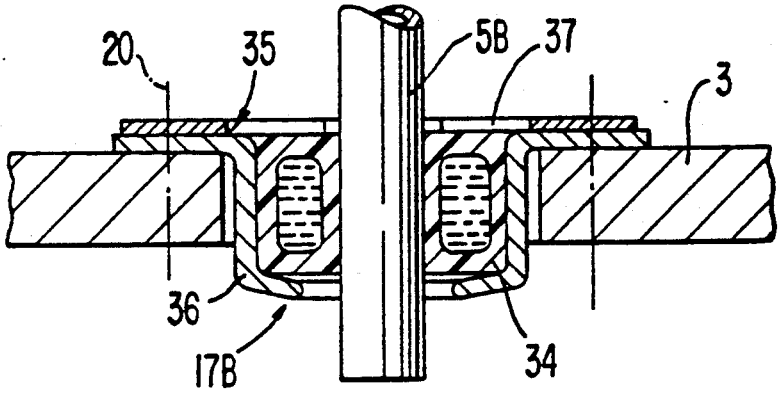
FIG. 3 is an axial sectional view of another embodiment similar to FIG. 2.
Figure 4:
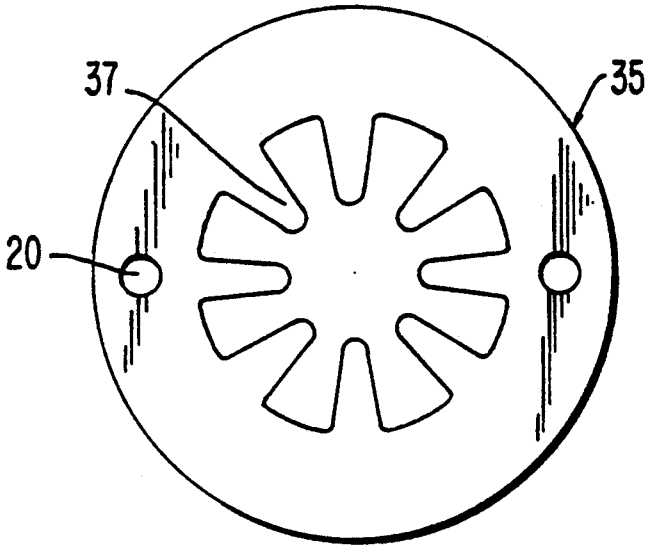
FIG. 4 is a top plan view of a component of the embodiment according to FIG. 3.

In the embodiment according to FIG. 3, the lower structural component assembly 17B includes a damping ring 34 which is essentially rectangular in its cross-section is inserted into a cup-shaped housing 36 fastened to the lower leg 3 of the spindle rail 1. The cup-shaped housing 36, in the above-described manner, is radially alignably fastened to the leg 3 of the spindle rail 1 by means of screws 20. Toward the top, the cup-shaped housing 36 is covered by means of a spring disk 35 which is also held by means of the screws 20 and, by means of fingers 37, extends into the area of the damping ring 34 (see also FIG. 4). In this embodiment, a deforming of the damping ring 34 takes place essentially in the direction of the fingers 37 of the spring ring 35 so that these elastic fingers 37 apply an additional restoring force and thus a centering force. In order to protect the bearing housing 5B in the area of the damping ring 34, it may be provided with a corresponding coating, such as a plasma coating or with a fitted-on sleeve, particularly a plastic sleeve.

Figure 5:
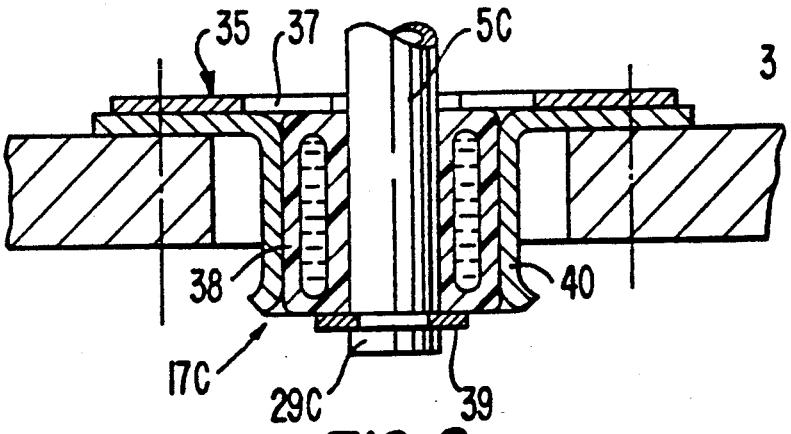
FIG. 5 is an axial sectional view of another embodiment of a lower structural component of a holding arrangement for the spindle bearing housing.

The embodiment of the lower structural component assembly 17C according to FIG. 5 corresponds essentially to the embodiment according to FIG. 3. One difference consists of the fact that the damping ring 38 is held in a sleeve 40 which is open on both sides. The securing of the damping ring 38 in the downward direction takes place by means of a spring ring 39 fastened to the end 29C of the spindle bearing housing 5C. Toward the top, the damping ring 38 is covered by means of a spring disk 35 which projects into the area of the damping ring 38 by means of fingers 37.

Figure 6:
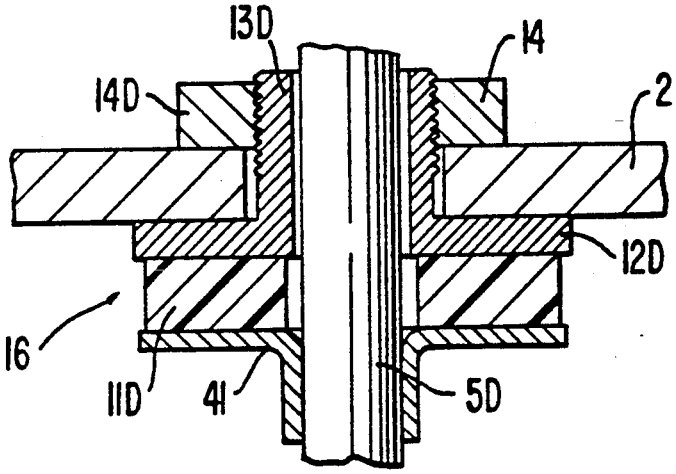
FIG. 6 is a view of a modification in comparison to FIG. 1 of the upper structural component of the holding arrangement of the spindle bearing housing.

FIG. 6 shows a modification of the upper structural component assembly 16D of the holding arrangement which, however, in its construction corresponds to the structural component assembly 16 described by means of FIG. 1. In the embodiment according to FIG. 6, the spindle bearing housing 5D is constructed as a tube which, also in the area of the upper (not shown) bolster, extends with the same diameter. At the spindle bearing housing 5D, a ring flange 41 is fastened which has a cylindrical projection and which, by means of a rubber-elastic intermediate ring 11D which is vulcanized on, is connected with a ring flange 12D which is also vulcanized to the intermediate ring 11D. The annular flange 12D is provided with a threaded projection 13D which is fitted through a bore of the leg 2 and onto which a nut 14D is screwed. As shown in FIG. 6, in this embodiment, a threaded attaching to the leg 2 of the spindle rail 1 takes place from below so that the axial forces are absorbed by the intermediate ring 11D as tensile forces.

Figure 7:
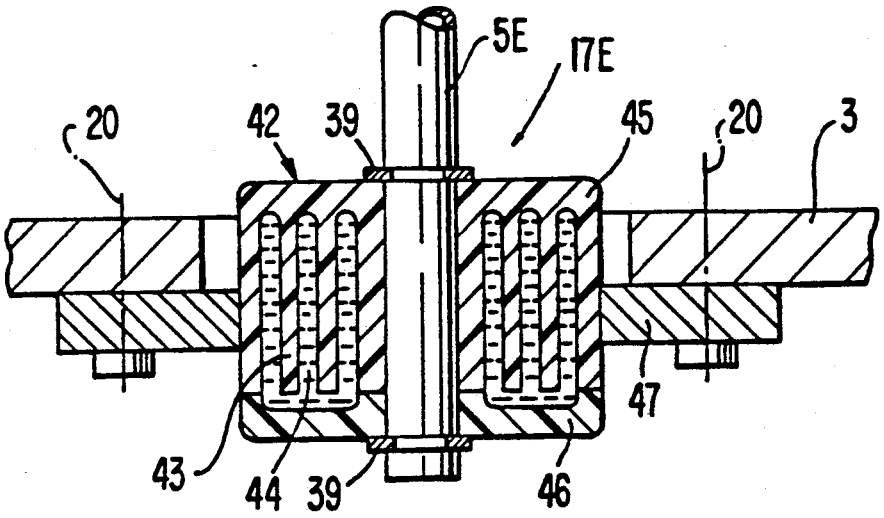
FIG. 7 is an axial sectional view of another embodiment of a damping device of the lower structural component of a holding arrangement.

In the embodiment of a lower structural component 17E of a holding arrangement for a spindle bearing housing 5E according to FIG. 7, a damping ring 42 is fastened to the spindle bearing housing 5E between two locking rings 39. The damping ring 42 is aligned in the radial direction by means of a guide ring 47 which, in the above-described manner, adjustably by means of screws 20, is fastened to the leg 3 of the spindle rail 1.

The damping ring 42 according to FIG. 7 has two parts 45, 46 made of an elastic plastic material which are welded together with one another and which form several annular or helical chambers 43, 44 with one another which are filled with a viscous fluid, such as oil. When the spindle bearing housing 5E swings out radially, the damping ring 42 is elastically deformed, in which case, the fluid located in the area which is now compressed must flow to the area which is widened at the same time. This results in a good damping effect.

In an embodiment which is modified with respect to the embodiment according to FIG. 7, an insert of a spongy porous foam is applied between the two parts 45, 46 of the damping ring 42.

Figure 8:
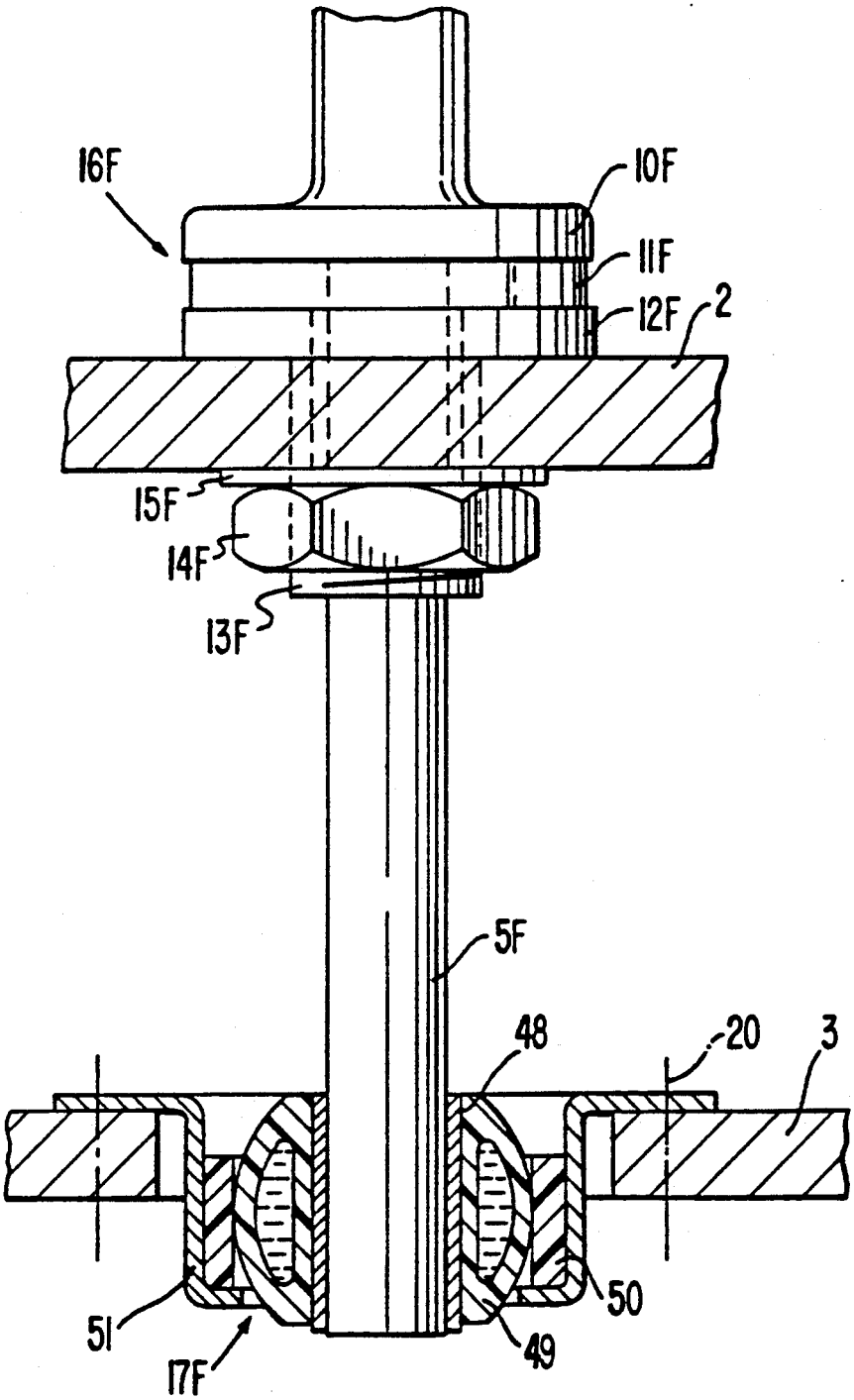
FIG. 8 is a partial sectional view of a spinning or twisting spindle designed according to the invention having centering and vibrations damping devices in the area of a lower structural component of a holding arrangement for the spindle bearing housing.

FIG. 8 shows an embodiment of the invention in which the upper structural component assembly 16F corresponds to the holding arrangement of the embodiment according to FIG. 1. The lower structural component assembly 17F, which applies the centering forces and the damping forces, comprises a cup-shaped housing 51 which is fastened to the lower leg 3 of a spindle rail 1 by means of screws 20 so that it can be adjusted in the radial direction. In the area of its lower end, the spindle bearing housing 5 is provided with a thin-walled pressed-on metal sleeve 48 against which a cylindrical interior surface of a damping ring 49 is supported. The damping ring 49 has a convexly curved outer contour by means of which it rests against a plastic ring 50 which is inserted into the housing 51 on the inside. Also in this embodiment, it is again provided that the damping ring 49 has a hollow chamber which is filled with a material, such as a viscous fluid, which, when it is deformed, dissipates energy. The material of the damping ring 49 itself consists of a rubber-elastic material, particularly rubber, resulting in a restoring effect which leads to a centering.

Figure 9:
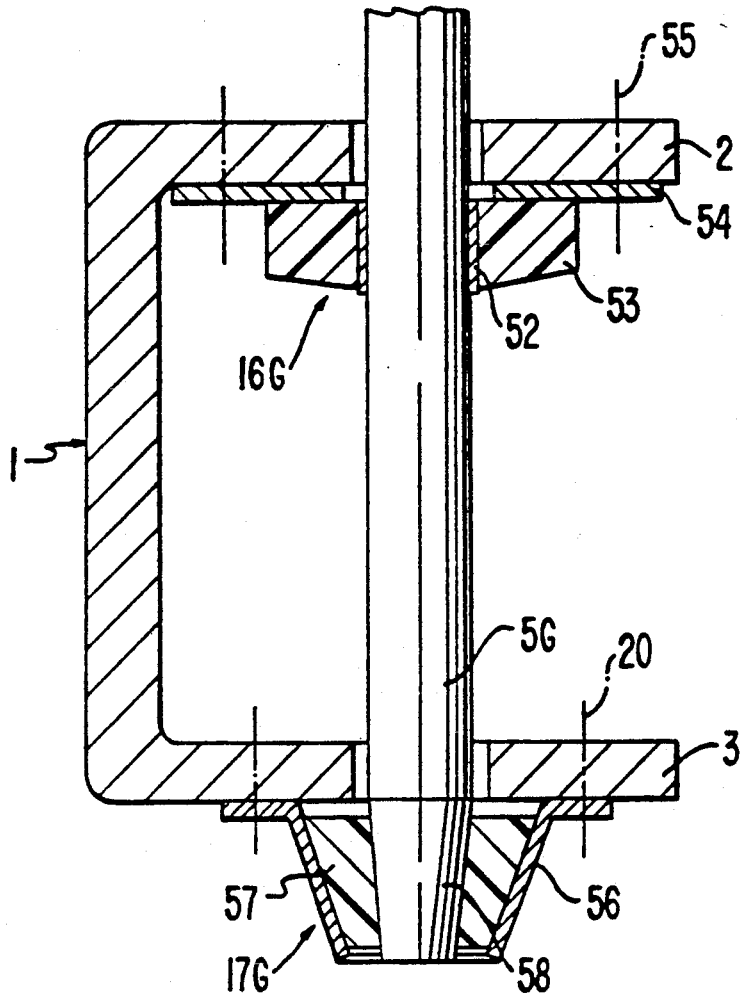
FIG. 9 is a partial axial sectional view of a spindle bearing housing having a holding arrangement at a spindle rail, the holding arrangement being subdivided into an upper and a lower structural component.

In the embodiment according to FIG. 9, simplified structural component assemblies 16*a*, 17*a* are provided which each contain a damping ring 53, 57 which is made of a material which has damping characteristics as well as centering characteristics; i.e., which, on the one hand, consumes a sufficient amount of energy during a deformation and, in addition, has a sufficient restoring force. The damping ring 53 of the upper structural unit 16G is vulcanized or glued to a thin metal sleeve 52. At its upper horizontal surface, an annular flange 54 is fastened by means of vulcanizing or gluing and, by means of screws 55, is fastened from below to the leg 2 of the spindle rail 1. As shown in FIG. 9, the annular flange 54 maintains a sufficient distance from the spindle bearing housing 5G and also from the sleeve 52 so that the upper structural component is radially movable.

The damping ring 57 of the lower structural component 17G has a slightly conical shape and is correspondingly held in a conical housing 56 which from below is held at the lower leg 3 of the spindle rail 1 by means of screws 20 in such a manner that a radial adjustment is possible. The lower end 58 of the spindle bearing housing 5G also tapers in a conical manner. As a result of the conical shape, it is possible to generate a certain prestress in the damping ring 57. As a modification of the shown embodiment, it is provided in another embodiment that the housing 56 is provided with one or several slots in the longitudinal direction so that its conical wall is subdivided into individual flexible tongues. These flexible tongues, on the one hand, permit a deformation of the damping ring 57, while, on the other hand, they increase the restoring forces required for the centering.

Figure 10:
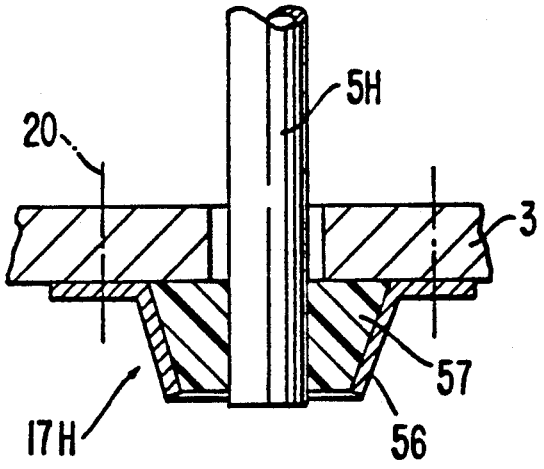
FIG. 10 is a view of a detail of a spindle bearing in the area of the lower structural component similar to FIG. 9.

The embodiment of the lower structural component assembly 17H according to FIG. 10 differs from the embodiment according to FIG. 9 in that the spindle bearing housing 5H is constructed as a cylindrical pipe also in its end area. Here also, it is possible to dimension the damping ring 57 such that it is prestressed when the housing 56 is fastened to the leg 3 of the spindle rail 1.

Figure 11:
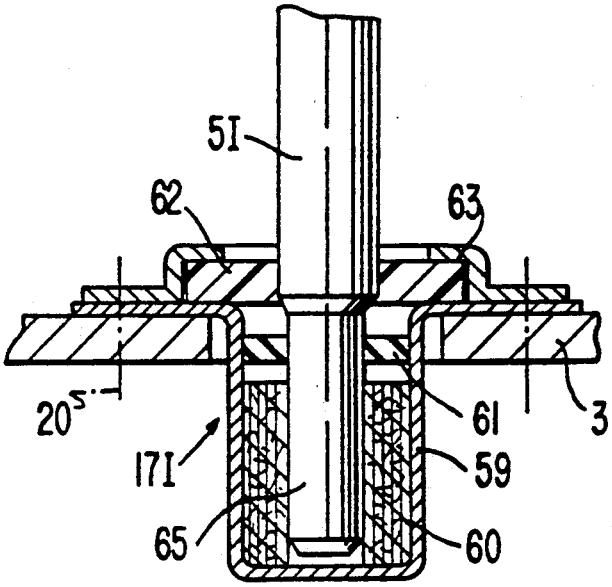
FIG. 11 is an axial sectional view of an embodiment of a lower structural component of a holding arrangement for a spindle bearing housing which is divided into two structural components, this lower structural component comprising an oil spiral.

In the embodiment of the lower structural component assembly 17I according to FIG. 11, the lower end 65 of the spindle bearing housing 5I which is reduced in its diameter is damped and centered by means of an oil spool 60. The oil spool 60, which is formed from a helically wound spring plate, is disposed in a cup-type housing 59 which, with a flange, is fastened to the lower leg 3 of a spindle rail by means of screws 20. In the above-described manner, this lower structural component 17 can be radially aligned. Inside the housing 59, above the oil spool 60, a sealing element 61 is disposed which has a U-shaped cross-section and with both of its legs is directed toward the bearing housing 5I. Above this sealing ring, another rubber-elastic sealing ring 62 is disposed which is enclosed by a cap 63 which closes the housing 59 in the upward direction and which is also held by means of screws 20. Under certain circumstances, it may be useful in this embodiment to provide an elastic base between the flange of the housing 59 and the leg 3 of the spindle rail 1 in order to avoid a noise bridge In the embodiment according to FIG. 12, a holding arrangement is also provided which is divided into an upper structural component assembly 16J and into a lower structural component assembly 17J. The upper structural component assembly 16J comprises a damping ring 66 which is vulcanized or glued to a thin metal sleeve 67 which is pressed onto the spindle bearing housing 5J. At the bottom side of the damping ring 66, an annular flange 68 is mounted by means of gluing or vulcanizing which is provided with a threaded insert 13J onto which a nut 14J is screwed.

Figure 12:
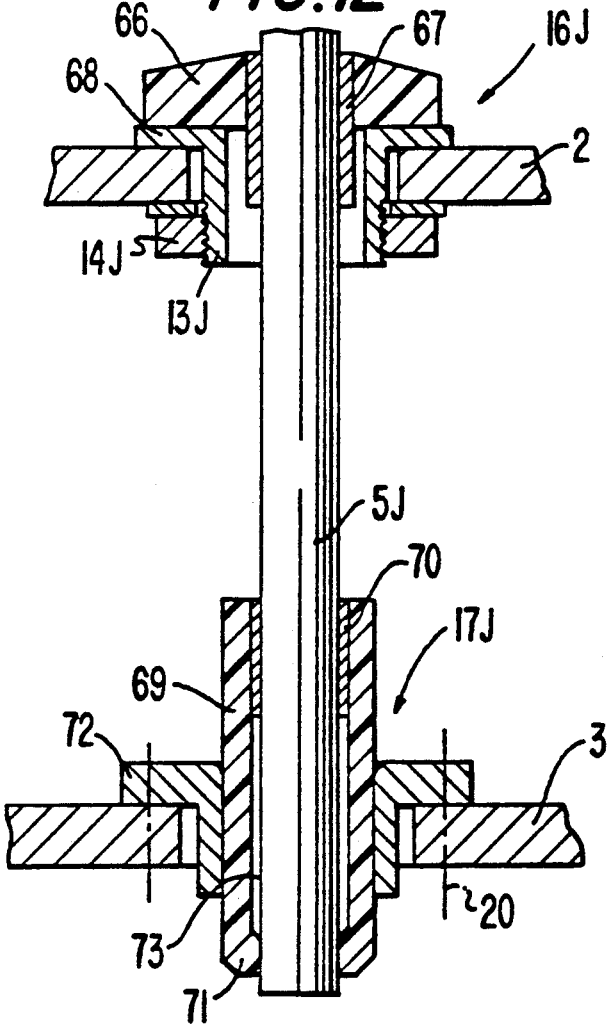
FIG. 12 is an axial sectional view of another embodiment of the invention.

The lower structural component assembly 17J of the holding arrangement according to FIG. 12 comprises a sleeve-shaped damping device 69 which extends over the lower area of the spindle bearing housing 5J. The upper end of the sleeve-shaped damping device 69 is connected with a thin metal sleeve 70 which is pressed onto the spindle bearing housing 5J. The lower end 71 of the damping device 69 supports itself directly at the spindle bearing housing 5J. An annular gap 73 is left in-between. In the area of the annular gap 73, the damping device 69 is guided by means of a guide ring 72 which, radially adjustable by means of screws 20, is fastened to the leg 3 of a spindle rail 1. As a result of spindle movements, the sleeve-shaped damping device 69 can yield in the area of the annular gap 73. Material is used which has sufficient damping characteristics and at the same time also restoring characteristics by means of which the spindle bearing housing 5J is centered again. In a modified embodiment, it may be provided that, in addition to the sleeve-shaped damping device 69, a metallic spring is provided which surrounds it and which is also enclosed by the guide ring 72 and which then applies elastic restoring forces. This spring may, for example, consist of a ring with several tongues extending in the axial direction which extend in the axial direction on the outside along the sleeve-shaped damping device 69.

Figure 13:
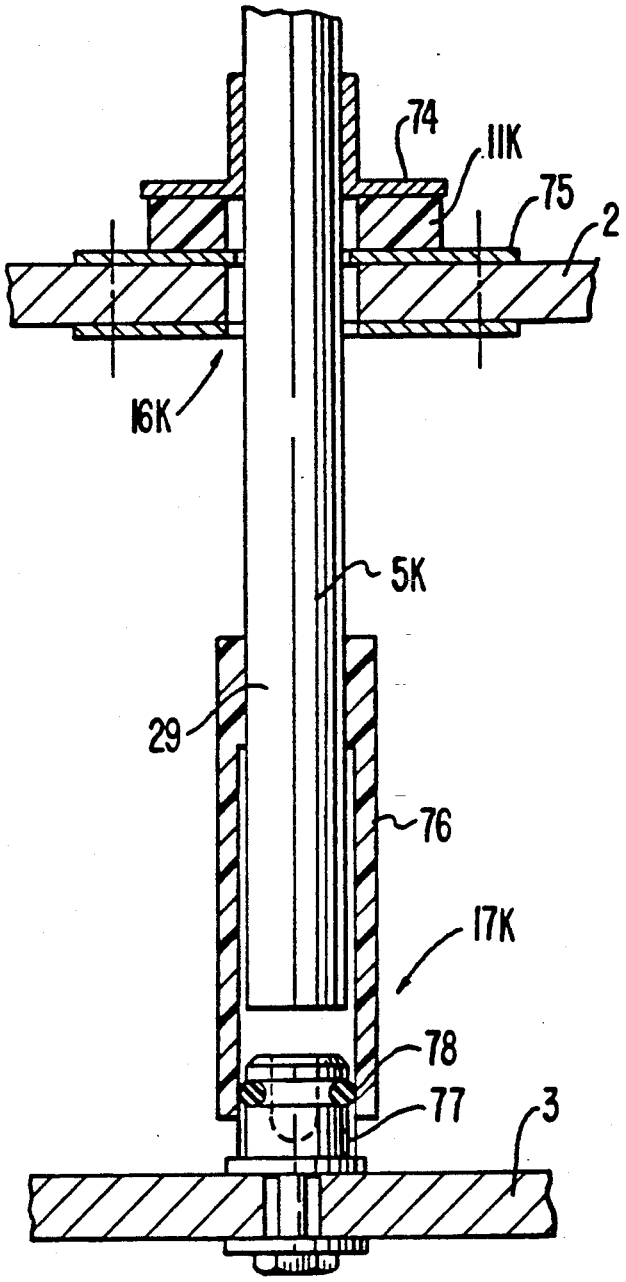
FIG. 13 is an axial sectional view of an embodiment of the invention having a lower structural component of the holding arrangement of the spindle bearing housing constructed in the manner of a basket spring.

In the embodiment according to FIG. 13, the upper structural component assembly 16K of the holding arrangement, in its construction, corresponds essentially to the embodiment according to FIG. 1. An annular flange 74 is fastened to the spindle bearing housing 5K and has a sleeve-shaped projection. At this annular flange 74, an intermediate ring 11K made of a rubber-elastic material is mounted which is connected with another annular flange 75 which is fastened to the upper leg 2 of the spindle rail 1. The spindle bearing housing 5K maintains a sufficient distance to the bore of the leg 2 of the spindle rail 1 and to the inside diameter of the annular flange 75.

The lower structural component assembly 17K comprises a sleeve-shaped damping element 76 which is arranged in the area of the lower end 29 of the spindle bearing housing 5K. This sleeve-type damping element 76 is mounted in the area of its upper end with a seat at the spindle bearing housing 5K and, if necessary, is secured by gluing or the like. The remaining area, which maintains an annular gap with respect to the spindle bearing housing 5K and which, in the downward direction, projects beyond the lower end of the spindle bearing housing 5K, reaches around a pin 77 mounted adjustably in the radial direction at the leg 3 of the spindle rail 1 as an axial extension of the spindle bearing housing 5K. An elastic ring 78, such as an 0-ring, is mounted at the pin 77, the damping element 76 reaching around the elastic ring 78.

In order to influence the damping effect and/or the centering function, it is provided in a modified embodiment of FIG. 13 that the sleeve-shaped damping element 76 is provided with longitudinal slots or only with one helically extending longitudinal slot. In another embodiment similar to FIG. 13, it is provided that the sleeve-shaped damping element 76 is combined with an elastic centering device, such as a spring surrounding it in the manner of a basket. Instead of a basket-type spring, a coil spring may also be provided which reaches around the damping element 76. This coil spring or this basket-type spring may be embedded in the material of the sleeve-shaped damping element 76.

Figure 14:
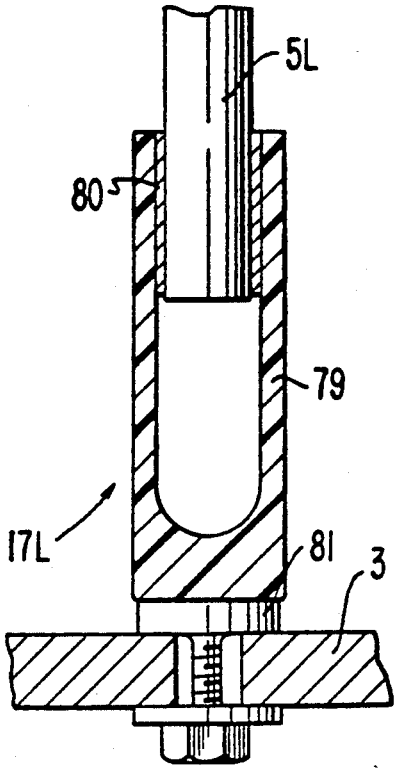
FIGS. 14 to 19 are axial sectional views of embodiments lower structural components of holding arrangements for spindle bearing housings.

Also in the embodiment according to FIG. 14, the lower end of the spindle bearing housing 5L is held at the lower leg 3 of a spindle rail 1 by means of a tube-shaped damping element 79 of the lower structural component assembly 17L of the holding arrangement. The sleeve-shaped damping element 79 reaches around a thin metallic sleeve 80 mounted on the spindle bearing housing 5L. The closed bottom of the sleeve-shaped damping element 79 is connected with a threaded bolt 81 which penetrates the leg 3 in a bore with play and which therefore can also be adjusted in the radial direction. Also in this embodiment, it is possible to, in addition, provide a spring which applies radial restoring forces and/or to provide the sleeve-shaped damping element 79 with longitudinal slots or a helical-line-shaped slot.

Figure 15:
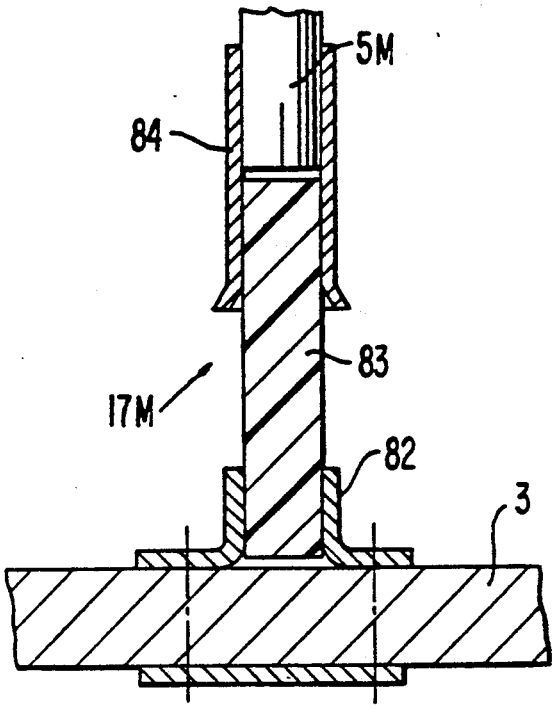

In the embodiment according to FIG. 15, the lower structural component assembly 17M of the holding arrangement comprises a cylindrical bolt-type damping element 83 which holds the bearing housing 5M in the radial direction. The damping element 83, adjustably in the radial direction by means of a guide sleeve 82, is fastened to the lower leg 3 of the spindle rail 1. At the lower end of the spindle bearing housing 5M, a guide sleeve 84 is mounted which reaches around the damping element 83 and has a diameter which corresponds to the diameter of the spindle bearing housing 5M.

Figure 16:
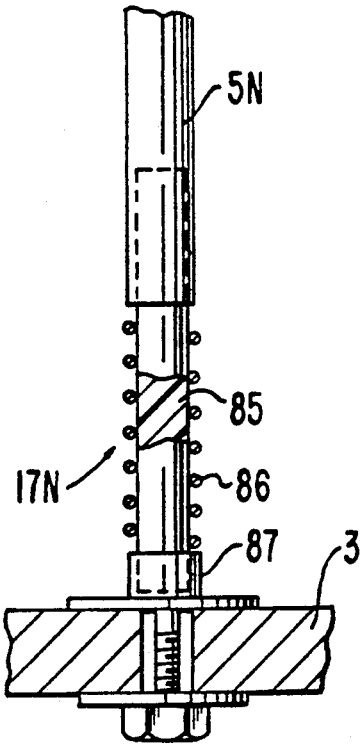

In principle, the embodiment of the lower structural component assembly 17N according to FIG. 16 corresponds to the embodiment according to FIG. 15. In this embodiment, the connection between the cylindrical damping element 85 and the spindle bearing housing 5N takes place by means of the fact that the spindle bearing housing 5N accommodates the damping element 85 with a corresponding fit and encloses it. In addition, the cylindrical damping element 85 is surrounded by a coil spring 86. In this embodiment, the function of damping is therefore separated from the function of elastic centering or restoring. The damping element 85 is essentially designed for vibration damping, while the coil spring 86 essentially causes the centering forces for maintaining the adjusted spindle centering.

Figure 17:
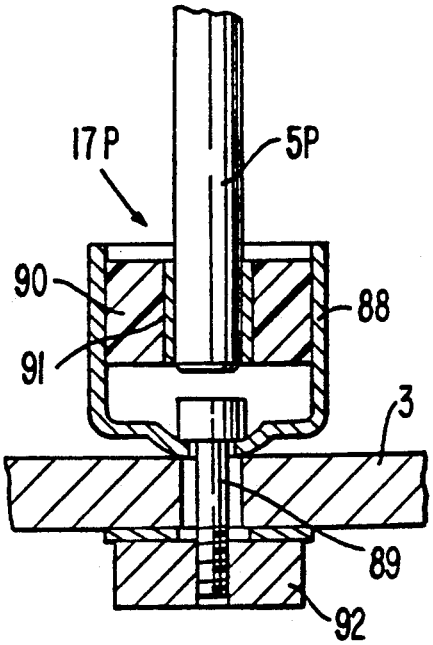

The embodiment of a lower structural component assembly 17P of a holding arrangement for a spindle bearing housing 5P shown in FIG. 17 comprises a cup-shaped housing 88 the bottom of which is penetrated by a screw 89 which penetrates the lower leg 3 of a spindle rail 1 in a relatively large bore and which is fastened to this leg 3 by means of a threaded ring 92 so that it can be adjusted in the radial direction with respect to the spindle bearing housing 5P.

The cup-shaped housing 88 of the embodiment according to FIG. 17 which is open toward the top is provided with a damping ring 90 which encloses a sleeve 91 of the spindle bearing housing 5.

Figure 18:
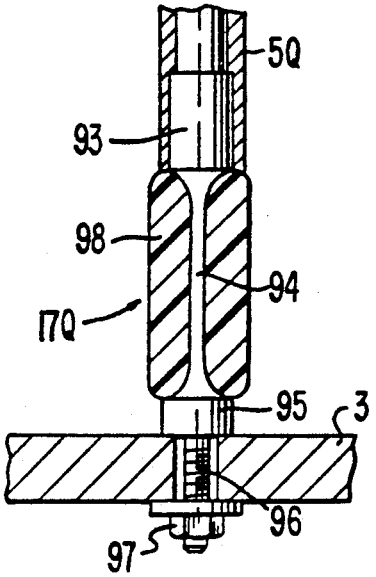

In the embodiment of the lower structural component assembly 17Q according to FIG. 18, the spindle bearing housing 5Q is closed in the downward direction by means of an insert 93 which, under certain circumstances, may be the step bearing on which the lower end of a spindle shaft is supported. The insert 93 is extended by a needle-shaped projection 94 which projects out of the spindle bearing housing 5Q and which changes into a widened head 95 which is followed by a bolt 96 provided with an external thread which penetrates the lower leg 3 of a spindle rail 1 with a radial play and onto which a nut 97 is screwed with the insertion of the washer. The needle-shaped projection 94 is surrounded by a collar-shaped damping element 98 made of a suitable damping material. The needle-shaped projection 94 has a diameter in the order of from 2.5 mm to 3 mm. This needle-shaped projection 94 acts as an elastic centering device, the movements of which are dampened considerably by the collar-shaped damping element 98.

In the embodiment according to FIG. 19, the lower structural component assembly 17R of the holding arrangement of the spindle bearing housing 5R comprises a sleeve-shaped damping element 100 which is fastened from below to the leg 3 of a spindle rail 1. The sleeve-shaped damping element 100 reaches around the lower end of the spindle bearing housing 5R which projects freely through the spindle rail 1, a thin metal sleeve 101 being arranged between the damping element 100 and the spindle bearing housing 5R. In addition the sleeve-shaped damping element 100 surrounds the spindle bearing housing 5R by means of an annular chamber 102 and, in the area of its upper end, is enclosed by a sleeve 99 which is fastened from below to the leg 3 of the spindle rail 1. Here also, the fastening by means of screws 20 is designed such that an adjustment is possible in the radial direction.

Figure 19:
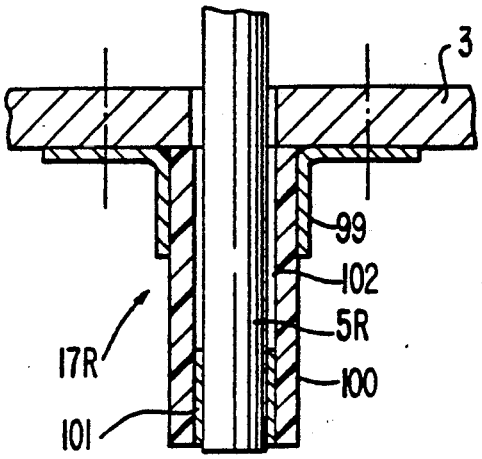

In a modified embodiment according to FIG. 19, it is provided that the sleeve 99 extends over a larger length or over the whole length of the damping element 100 and is designed as a spring device which, with respect to its rigidity, is designed by means of longitudinal slots or one or several helical slots.

In a further embodiment which is modified with respect to the embodiment according to FIG. 19, it is provided that the annular chamber 102, between the damping element 100 and the bearing housing 5R, is filled with a damping medium, such as a viscous fluid. In this case, it is advantageous to seal off the annular chamber in the area of its upper end by means of an additional sealing ring, particularly an O-ring.

Figure 20:
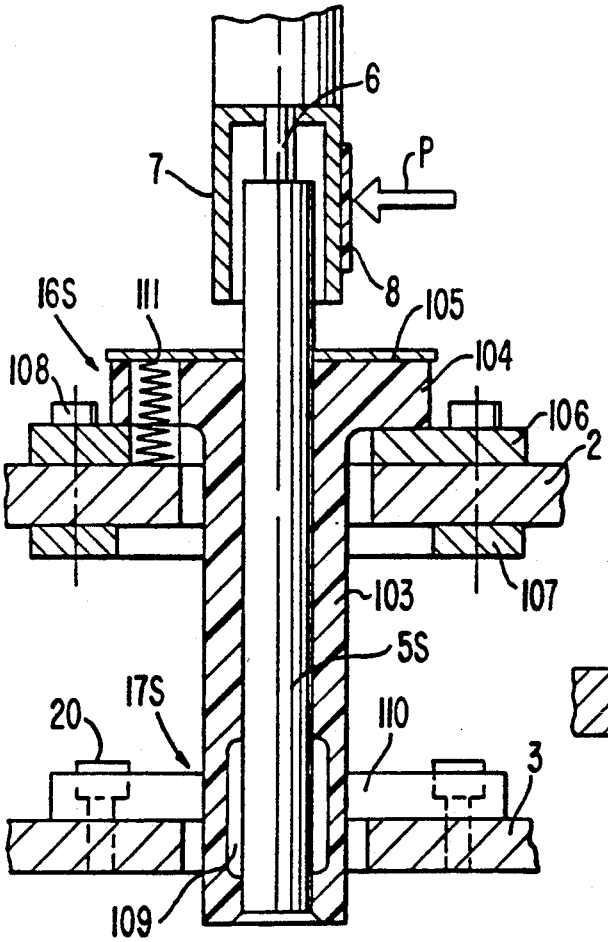
FIG. 20 is a longitudinal sectional view of a holding arrangement embodiment extending over the distance between two flanges of a spindle rail and of a compensating spring.

In the embodiment according to FIG. 20, the spindle bearing housing 5S, along the whole area of its length which is located in the spindle rail, is provided with a sleeve-shaped damping element 103. In the area of the bolster, the sleeve-shaped damping element 103 forms an annular flange 104 which is connected with a thin annular flange 105 made of sheet metal which is welded to the spindle bearing housing 5S. In addition, the annular flange 104 of the damping element 103 is also connected with another annular flange 106 which, by means of screws 108 penetrating the upper leg 2 of the spindle rail 1, is screwed together with a threaded ring 107 resting against the bottom side of the leg 2.

In the area of the lower leg 3 it is provided in the embodiment according to FIG. 20 that the damping element 103 forms an annular chamber 109 with the bearing housing 5S. This area is bordered by means of a guide ring 110 which, adjustably in the radial direction, is fastened to the lower leg 3 by means of screws 20. The annular chamber 109 may be filled with additional damping material, such as a viscous fluid or an open-pored foamed material.

In the embodiment according to FIG. 20, a compensating spring 111 is also provided which compensates for the load (P) originating from the tangential belt 8 which, by means of contact pressure rollers which are not shown, is pressed against the driving wharve 7 of the spindle shaft 6 in the direction of the load (P). The compensating spring 111, which is constructed as a pressure spring, is arranged between the annular flange 105 and the leg 2 of the spindle rail 1 and generates a torque which is directed against the torque generated by the tangential belt 8 and compensates it as completely as possible. Thus it is ensured that, as a result of the load exercised by the tangential belt 8, no permanent deformations of the damping element- 103 are caused. This type of a compensating spring is advantageously also provided in all other embodiments in which there is the risk of permanent deformations in the area of the damping device caused by a constant load.

Figure 21:
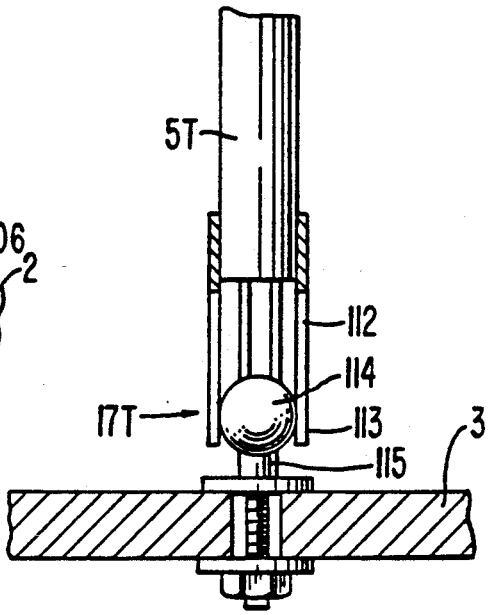
FIG. 21 is an axial sectional view of another embodiment of a lower structural component of a holding arrangement having a basket-spring-type centering device.

FIG. 21 shows an embodiment of a lower structural component assembly 17 of a holding arrangement of a spindle bearing housing 5T in which the lower end of the spindle bearing housing 5T is provided with a basket spring 112. The spring arms 113 of the basket spring 112 reach around a spherical head 114 which is mounted on a threaded bolt 115 which, in a radially adjustable manner, by means of a nut and a washer is fastened to the lower leg 3 of the spindle rail 1. The spherical head 114 advantageously consists of a rubber-elastic material. The spherical head may, for example, be connected with the threaded bolt 115 by means of gluing or vulcanizing.

Figure 22:
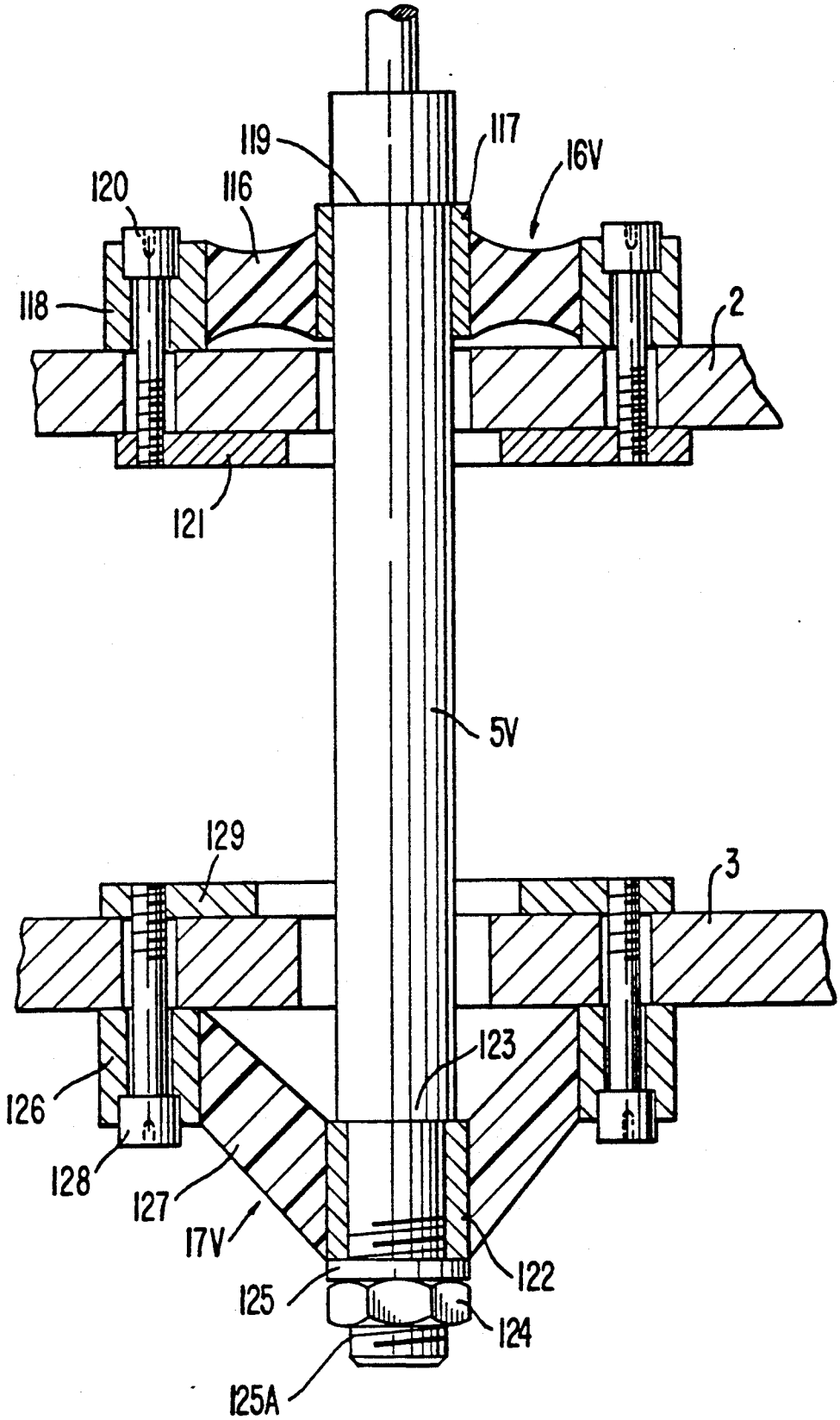
FIG. 22 is an axial sectional view of another embodiment of the invention.

In the embodiment according to FIG. 22, the upper structural component assembly 16V of the holding arrangement comprises a radially enclosed damping ring 116. On the inside, the damping ring 116 is provided with a pressure sleeve 117 which is pushed and pressed onto the spindle bearing housing 5V.

In the embodiment according FIG. 22, it is provided that the spindle bearing housing 5V has an annular collar 119 against which the sleeve 117 supports itself in the axial direction. On the outside, the damping ring 116 is enclosed by means of a retaining ring 118 which, by means of screws 120 penetrating the upper leg 2 of a spindle rail 1, is fastened to a threaded ring 121 resting from the bottom side against this leg 2.

The lower structural component assembly 17V of the holding arrangement also has a damping ring 127 which, in the radial direction, is fastened to a sleeve 122 and a fastening ring 126. By means of a sliding fit or a slight press fit, the sleeve 122 is pushed onto a section of the spindle bearing housing 5V which has a reduced diameter and is supported at an annular collar 123. This sleeve 122 is screwed on, with the insertion of an intermediate ring 125, by means of a nut 124 screwed onto the end of the spindle bearing housing 5V constructed with an external thread 125*a*.

The fastening ring 126 rests from below against the lower leg 3 of the spindle rail 1 and is secured by means of screws 128 penetrating it as well as by means of a threaded ring 129 mounted on the top side of the leg 3. Also in this embodiment, it is provided that the bores of the leg of the spindle rail 1 are designed to be sufficiently wide permitting a radial alignment of the fastening ring 126 and thus of the spindle bearing housing 5.

The damping ring 127 has the shape of a hollow truncated cone with a downwardly pointing tip. In order to be able to optimize the damping characteristics and the restoring or centering characteristics from one another as independently as possible, it is provided in a modified embodiment of the embodiment according to FIG. 22 that, in addition to the damping ring 127, a metal spring is provided, particularly a helical-line-shaped wire spring which is embedded in the material of the damping ring 127.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning or twisting spindle arrangement comprising:

a spindle shaft, a spindle bearing housing accommodating a bearing for the spindle shaft, said spindle shaft being radially fixed in the spindle bearing housing, a spindle rail including upper and lower axially spaced flanges, and holding devices at each of said flanges for holding the spindle bearing housing, each of the holding devices including rubber-elastic elements disposed between the flanges and the spindle bearing housing so as to prevent a metallic connection between the spindle bearing housing and the flanges while permitting radially swinging movements of the spindle bearing housing, wherein the holding devices at at least one of the upper and lower flanges includes radial aligning devices for accommodating selective adjustment of radial alignment of the spindle housing relative to the respective flange.

2. An arrangement according to claim 1, wherein the radial aligning device include elastic centering devices.

3. An arrangement according to claim 2, wherein the holding devices at the lower flange include a damping device having at least one chamber filled with deformable medium which can be deformed as a result of movements of the spindle bearing housing.

4. An arrangement according to claim 11, wherein the holding devices at the upper flange include an annular damping element arranged between a flange of the spindle bearing housing and the spindle rail.

5. An arrangement according to claim 1, wherein the holding device at the upper flange comprises an annular damping element arranged between a flange of the spindle bearing housing and the spindle rail.

6. A spinning or twisting spindle arrangement comprising:

a spindle shaft, a spindle bearing housing accommodating a bearing for the spindle shaft, said spindle shaft being radially fixed in the spindle bearing housing, a spindle rail including upper and lower axially spaced flanges, and holding devices at each of said flanges for holding the spindle bearing housing, each of the holding devices including rubber-elastic elements disposed between the flanges and the spindle bearing housing so as to prevent a metallic connection between the spindle bearing housing and the flanges while permitting radially swinging movements of the spindle bearing housing, wherein the holding devices at the lower flange include radial aligning devices for accommodating selective adjustment of radial alignment of the spindle housing relative to the respective flange, and wherein the spindle bearing housing is provided with an axial extension in the downward direction beyond the spindle shaft, and wherein the holding devices at the lower flange are applied to the axial extension.

7. An arrangement according to claim 6, wherein the axial extension of the spindle bearing housing is constructed as a lubricant reservoir.

8. An arrangement according to claim 6, wherein the holding devices at the lower flange include a damping device having at least one chamber filled with deformable medium which can be deformed as a result of movements of the spindle bearing housing.

9. An arrangement according to claim 6, wherein an annular flange is mounted at the spindle bearing housing which is connected by way of an elastic ring with an additional annular flange surrounding the spindle bearing housing at a distance, said additional flange being fastened to one of the spindle rail flanges.

10. An arrangement according to claim 6, wherein the holding devices include a spring element generating a torque on the spindle bearing housing acting against a torque caused by a driving belt in use, this spring element supporting itself against the spindle rail.

11. A spinning or twisting spindle arrangement comprising:

a spindle shaft, a spindle bearing housing accommodating a bearing for the spindle shaft, said spindle shaft being radially fixed in the spindle bearing housing, a spindle rail including upper and lower axially spaced flanges, and holding devices at each of said flanges for holding the spindle bearing housing, each of the holding devices including rubber-elastic elements disposed between the flanges and the spindle bearing housing so as to prevent a metallic connection between the spindle bearing housing and the flanges while permitting radially swinging movements of the spindle bearing housing, wherein the holding devices at the lower flange include radial aligning devices for accommodating selective adjustment of radial alignment of the spindle housing relative to the respective flange, and wherein the holding devices at the lower flange include a damping device having at least one metal spring.

12. An arrangement according to claim 11, wherein the holding devices at the upper flange include an annular damping element arranged between a flange of the spindle bearing housing and the spindle rail.

13. A spinning or twisting spindle arrangement comprising:

a spindle shaft, a spindle bearing housing accommodating a bearing for the spindle shaft, said spindle shaft being radially fixed in the spindle bearing housing, a spindle rail including upper and lower axially spaced flanges, and holding devices at each of said flanges for holding the spindle bearing housing, each of the housing devices including rubber-elastic elements disposed between the flanges and the spindle bearing housing so as to prevent a metallic connection between the spindle bearing housing and the flanges while permitting radially swinging movements of the spindle bearing housing, wherein the holding devices at the lower flange include radial aligning devices for accommodating selective adjustment of radial alignment of the spindle housing relative to the respective flange, and wherein the holding devices at the lower flange include a damping device having at least one chamber filled with deformable medium which can be deformed as a result of movements of the spindle bearing housing.

14. A spinning or twisting spindle arrangement comprising:

a spindle shaft, a spindle bearing housing accommodating a bearing for the spindle shaft, said spindle shaft being radially fixed in the spindle bearing housing, a spindle rail including upper and lower axially spaced flanges, and holding devices at each flanges for holding the spindle bearing housing, each of the holding devices including rubber-elastic elements disposed between the flanges and the spindle bearing housing so as to prevent a metallic connection between the spindle bearing housing and the flanges while permitting radially swinging movements of the spindle bearing housing, wherein the holding devices at the lower flange include radial aligning devices for accommodating selective adjustment of radial alignment of the spindle housing relative to the respective flange, and wherein an annular flange is mounted at the spindle bearing housing which is connected by way of an elastic ring with an additional annular flange surrounding the spindle bearing housing at a distance, said additional annular flange being fastened to one of the spindle rail flanges.

15. A spinning or twisting spindle arrangement comprising:

a spindle shaft, a spindle bearing housing accommodating a bearing for the spindle shaft, said spindle shaft being radially fixed in the spindle bearing housing, a spindle rail including upper and lower axially spaced flanges, and holding devices at each of said flanges for holding the spindle bearing housing, each of the holding devices including rubber-elastic elements disposed between the flanges and the spindle bearing housing so as to prevent a metallic connection between the spindle bearing housing and the flanges while permitting radially swinging movements of the spindle bearing housing, wherein the holding devices at the lower flange include radial aligning devices for accommodating selective adjustment of radial alignment of the spindle housing relative to the respective flange, and wherein the holding devices include a spring element generating a torque on the spindle bearing housing acting against a torque caused by a driving belt in use, this spring element supporting itself against the spindle rail.

* * * * *